US008752606B2

(12) United States Patent
Albrecht et al.

(10) Patent No.: US 8,752,606 B2
(45) Date of Patent: Jun. 17, 2014

(54) AWNING WITH SUPPORT SYSTEM HAVING ARTICULATED MOUNTING ARM

(75) Inventors: Jeffrey K. Albrecht, Goshen, IN (US); Christopher S. Greer, Leesburg, IN (US); Brian M. Worthman, Goshen, IN (US); Jeremiah R. Bradley, Syracuse, IN (US); Gary E. Groves, Syracuse, IN (US); David R. Wysong, Goshen, IN (US); Robert Herbert Schneider, Beaver Dam, WI (US)

(73) Assignee: Lippert Components, Inc., Elkhart, IN (US)

( * ) Notice: Subject to any disclaimer, the term of this patent is extended or adjusted under 35 U.S.C. 154(b) by 0 days.

(21) Appl. No.: 13/523,559

(22) Filed: Jun. 14, 2012

(65) Prior Publication Data

US 2013/0333736 A1 Dec. 19, 2013

(51) Int. Cl.
*E04F 10/06* (2006.01)

(52) U.S. Cl.
USPC ..... 160/67; 160/69

(58) Field of Classification Search
USPC ..... 160/66, 67, 69, 72, 78, 81
See application file for complete search history.

(56) References Cited

U.S. PATENT DOCUMENTS

| | | | | |
|---|---|---|---|---|
| 6,095,221 | A * | 8/2000 | Frey, Jr. | 160/67 |
| 6,098,693 | A * | 8/2000 | Frey, Jr. | 160/67 |
| 6,230,783 | B1 * | 5/2001 | Frey, Jr. | 160/67 |
| 6,273,172 | B1 * | 8/2001 | Frey | 160/67 |
| 6,276,424 | B1 * | 8/2001 | Frey, Jr. | 160/67 |
| 6,488,069 | B1 * | 12/2002 | Mashaw et al. | 160/67 |
| 7,967,050 | B2 * | 6/2011 | Gutierrez | 160/67 |

* cited by examiner

*Primary Examiner* — Blair M. Johnson
(74) *Attorney, Agent, or Firm* — Barnes & Thornburg LLP

(57) ABSTRACT

A retractable awning having a roller, a flexible canopy having one end secured to the roller and rollable onto the roller, and a motor operable to rotate the roller to roll the flexible canopy onto or off the roller. Top and bottom mounting arms extend from a support arm for the roller, with the bottom arm being articulated, and with an extensible strut pivotally connected to and extending between each top and bottom mounting arm.

19 Claims, 6 Drawing Sheets

FIG. 8
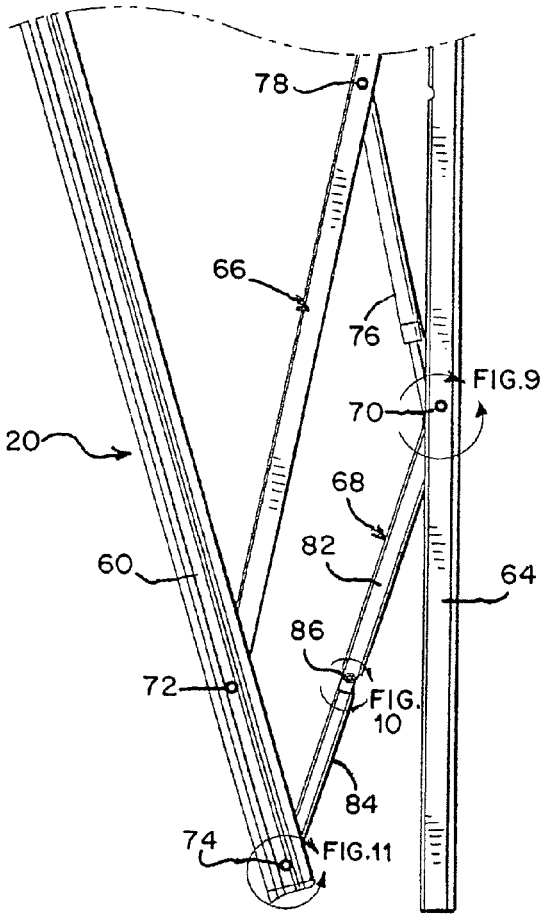
FIG. 9
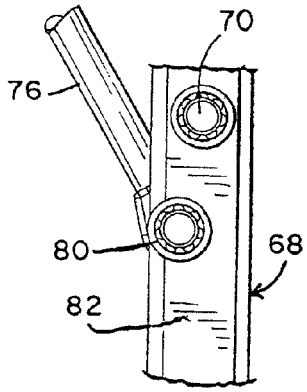
FIG. 10
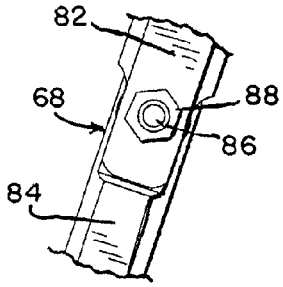
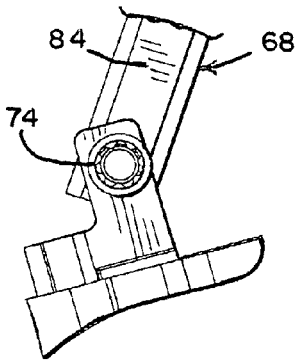
FIG. 11

AWNING WITH SUPPORT SYSTEM HAVING ARTICULATED MOUNTING ARM

BACKGROUND OF THE INVENTION

This invention relates to retractable awnings and, particularly, to a motor-driven awning having a support system including extensible strut extending between top and bottom mounting arms at connection locations spaced from a wall to which the awning is mounted.

Retractable awnings are used to create a shaded space. While the invention is described in relation to an awning having particular utility in relation to a recreational vehicle, it can also be used in connection with a stationary awning on a structure, such as awning extensible over a patio.

In such awnings, a flexible, typically fabric canopy is secured at one end to a wall and has an opposite end secured to a roller. The roller is supported at its ends by opposite support arms which are displaceable between an extended position for the awning, where the awning is deployed, and a retracted position, where the awning is rolled onto the roller for storage.

Awnings are usually extended in a fairly horizontal manner so as to provide maximum shading beneath the awning canopy when it is extended. A biasing means, such as a fluid strut, maintains that orientation.

SUMMARY OF THE INVENTION

The invention provides a retractable awning for mounting to a wall, with the awning including a roller and a flexible canopy having one end secured to the roller and rollable onto the roller. A pair of support arms supports opposite ends of the roller, with each support arm being operable to move from a retracted position proximate the wall where the arm is substantially vertical to an extended position where the arm is substantially horizontal and displaced from the retracted position. A pair of top and bottom mounting arms is pivotally connected to and extends from each support arm, with each top mounting arm being connected to an upper location on the wall and each bottom mounting arm being connected to a lower location on the wall. An extensible strut is pivotally connected to and extends between each top and bottom mounting arm at connection locations spaced from and displaceable from the wall.

In this form of the invention, the strut comprises a normally-extended pneumatic cylinder. Preferably, the lower mounting arm is articulated, with the lower mounting arm including first and second arm elements, the arm elements being adjustable relative to one another and being joined by an adjustment coupler.

The adjustment coupler comprises a bolt. In accordance with the preferred form of the invention, the adjustment coupler is self-regulating to axially align the arm elements.

BRIEF DESCRIPTION OF THE DRAWINGS

The invention is described in greater detail in the following description of examples embodying the best mode of the invention, taken in conjunction with the drawing figures, in which:

FIG. 8 is a greatly enlarged view of the mounting support system of the right-hand portion of the awning shown in FIG. 1, FIG. 9 is an enlarged illustration of the area 9 indicated on FIG. 8, FIG. 10 is an enlarged illustration of the area 10 illustrated on FIG. 8, and FIG. 11 is an enlarged illustration of the area 11 illustrated on FIG. 8.

DESCRIPTION OF EXAMPLES EMBODYING THE BEST MODE OF THE INVENTION

Figure 1:
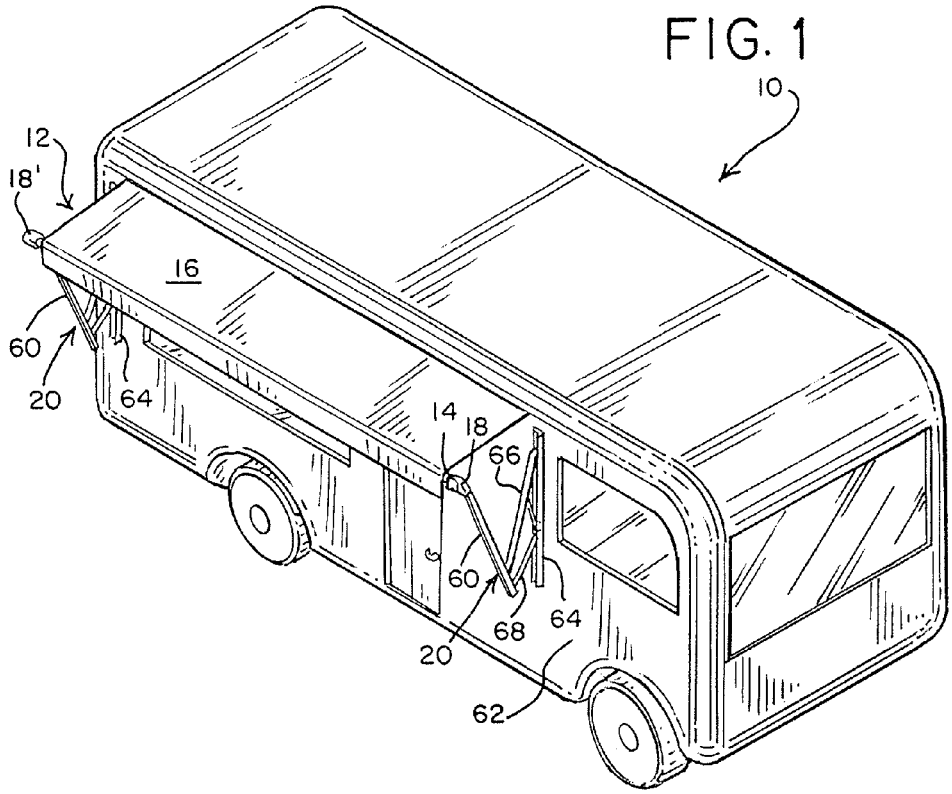
FIG. 1 is an isometric view of an awning according to the invention when installed on a recreational vehicle and being partially extended or retracted.
Figure 2:
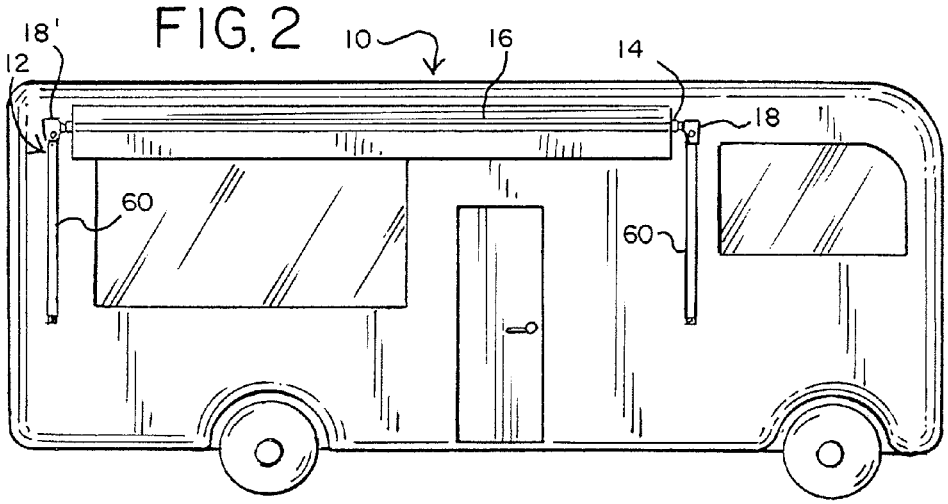
FIG. 2 is a side elevational view of the awning shown in FIG. 1.

A recreational vehicle 10, shown in FIGS. 1-4, includes an awning 12 mounted thereon. While the recreational vehicle 10 shown in the drawing figures is depicted as a self-propelled motor coach, the awning 12 can be used on any type of recreational vehicle and can also be used in a stationary location, such as for extending over a patio adjacent a home.

The awning 12 is, in many respects, conventional, in that it has a fabric canopy rollable onto an extensible roller. The awning 12 includes a roller 14, a flexible canopy 16 having one end secured to the roller 14 and rollable onto the roller 14 and with the opposite end affixed to the recreational vehicle 10, and a motor located within a protective housing 18 for rotating the roller 14 to extend or retract the awning 12. A support system 20, described in greater detail below, mounts the awning 12 for extension or retraction.

Figure 5:
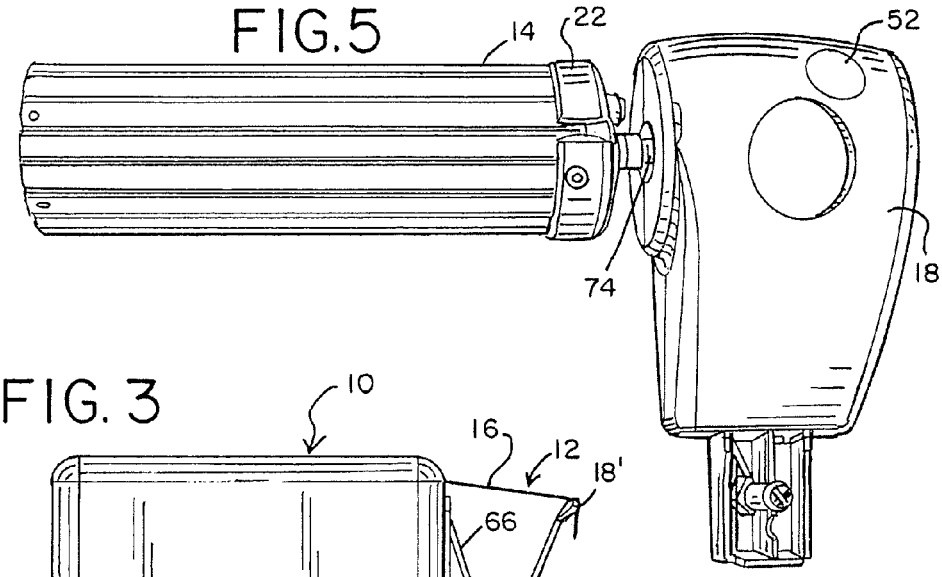
FIG. 5 is an enlarged illustration of the drive motor assembly according to the invention, shown connected to an awning roller.
Figure 3:
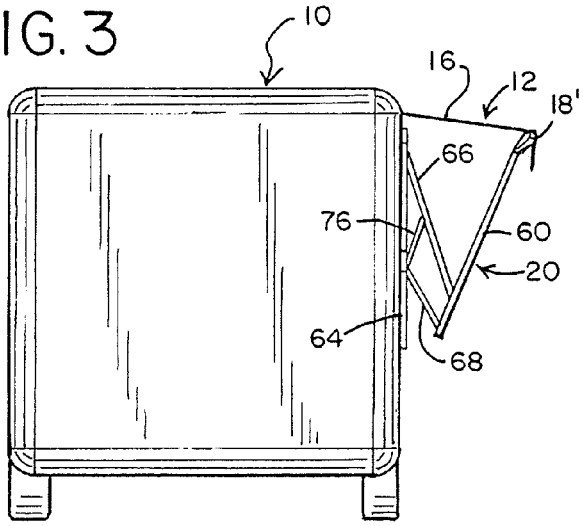
FIG. 3 is an end elevational view, taken from the left side of FIG. 2.
Figure 4:
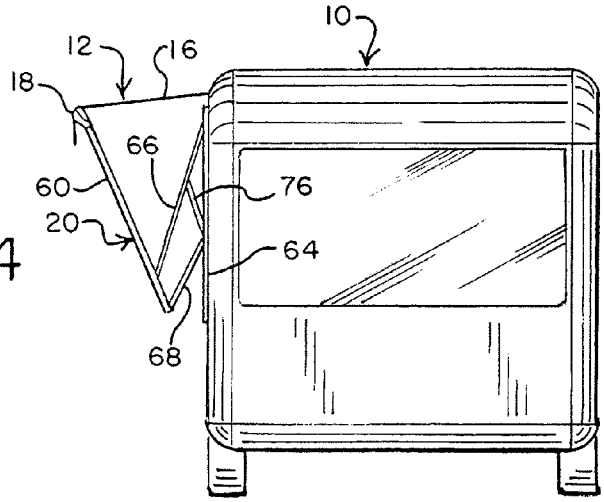
FIG. 4 is an end elevational view, taken from the right side of FIG. 2.
Figure 6A:
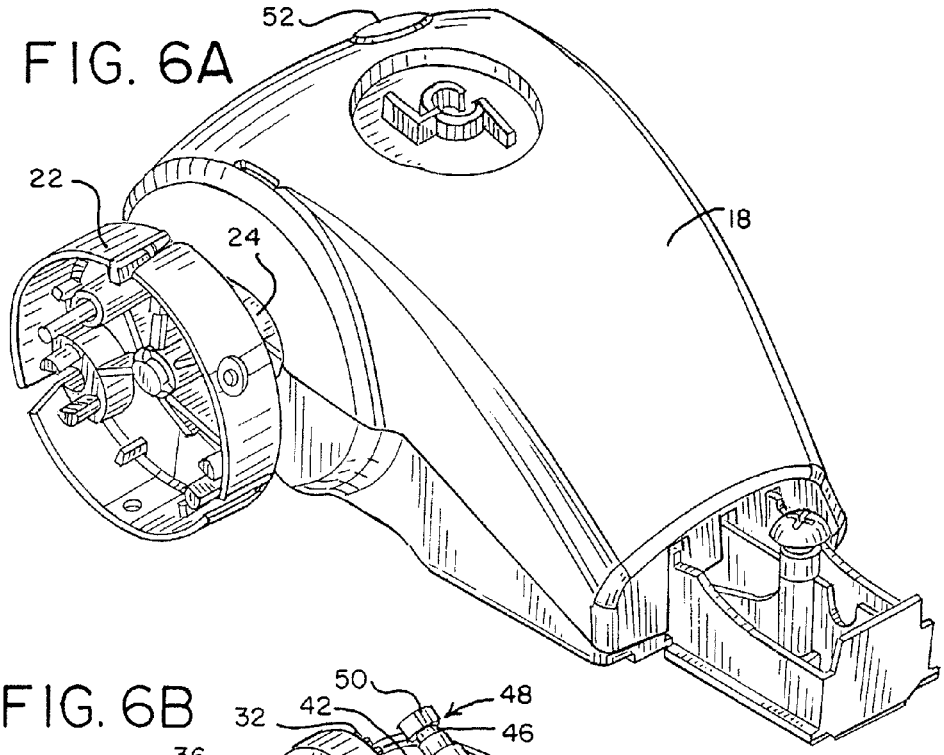
FIG. 6A is an enlarged isometric view of the motor of FIG. 5.
Figure 6B:
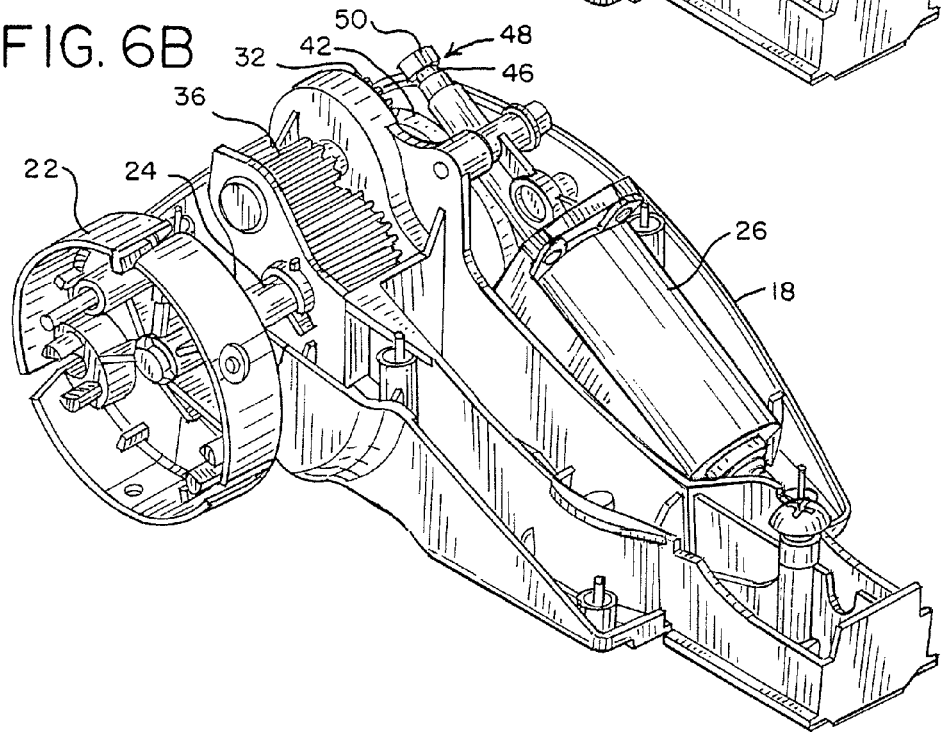
FIG. 6B is a view similar to FIG. 6A, but with part of the motor housing removed.

FIG. 5 illustrates connection of the roller 14 to a motor within the housing 18. As illustrated, an end cap 22 is secured to the roller 14 at its circumference, and the end cap 22 is fixed to a shaft 24 extending from the motor within the protective housing 18. The protective housing 18 is shown in FIGS. 6A and 6B, with a portion of the protective housing 18 removed in FIG. 6B to expose the contents thereof, including a motor 26 which is operable through gearing explained below to roll the flexible canopy 16 onto or off the roller 14 (as illustrated in FIGS. 1-4).

Only one motor is normally needed. Thus, while the opposite end of the roller 14 is capped by a similar housing 18', the housing 18' is just for aesthetic purposes, and mere shrouds connection of the roller 14 to the support system 20.

The motor 26 may be a conventional electric motor and is therefore not described in greater detail. The motor 26 rotates a drive gear 28 mounted on a spindle 30 extending from the motor. The drive gear 28, in turn, meshes with a drive wheel 32 journaled on a shaft 24. Also journaled on the shaft 34 is a further drive wheel 36 which meshes with a drive wheel 38 journaled on the shaft 24. Therefore, when the motor 26 is operated, by means of the drive gear 28 turning the drive wheels 32, 36 and 38, the shaft 24 is rotated, therefore rotating the roller 14 to either extend or retract the flexible canopy 16.

Figure 7:
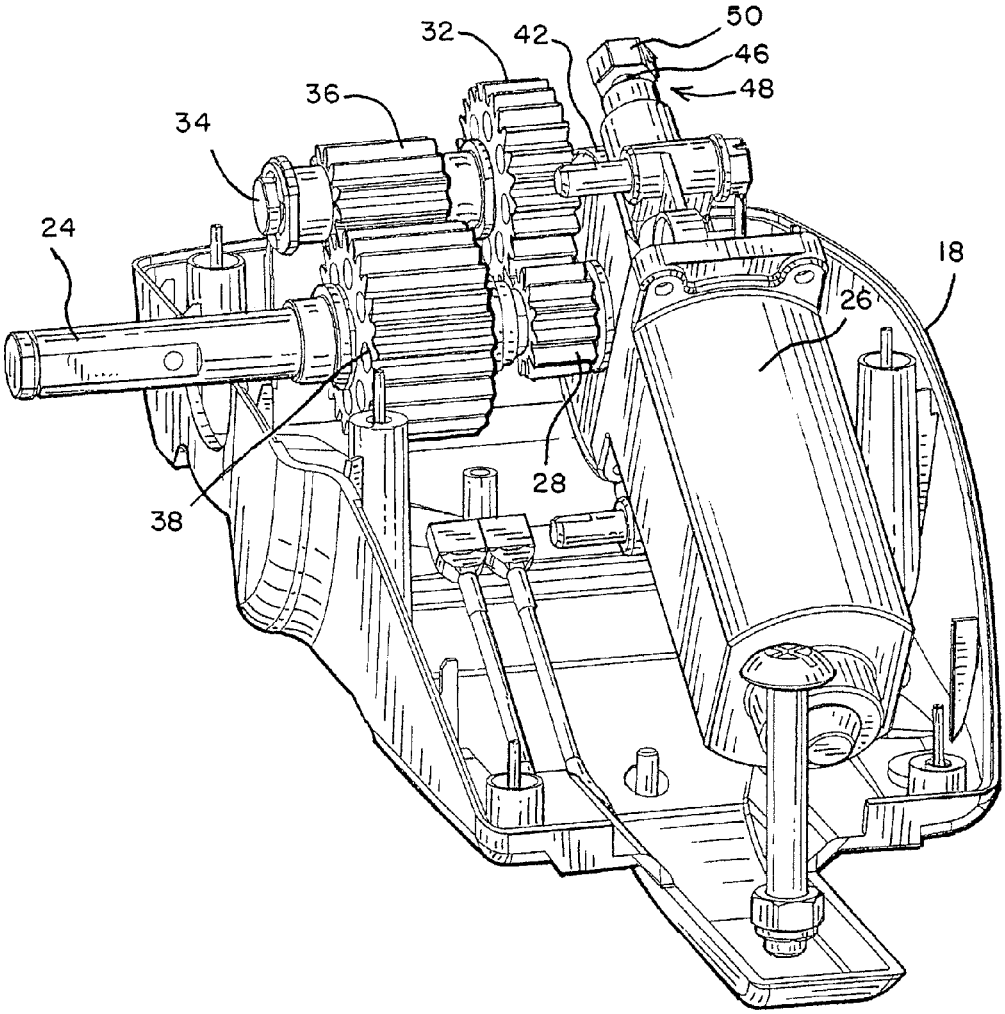
FIG. 7 is a view similar to FIG. 6B, but with further parts removed in order to illustrate detail.
Figure 7A:
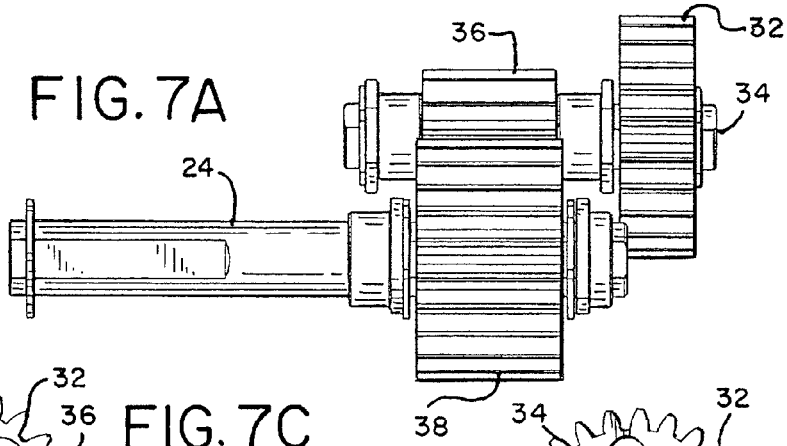
FIG. 7A is an elevational view of the drive gear assembly of the motor of FIG. 7.
Figure 7C:
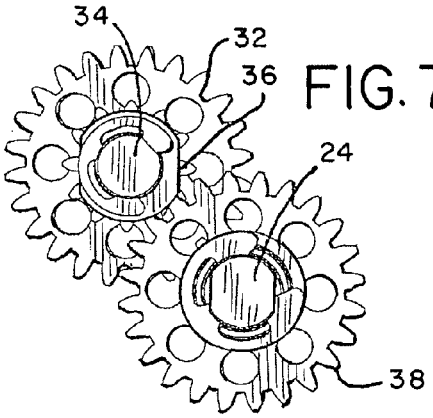
FIG. 7C is a left end view of the assembly shown in FIG. 7A.
Figure 7B:
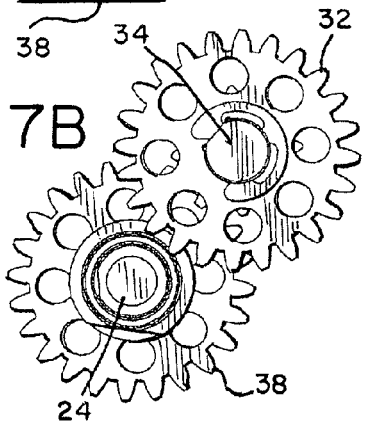
FIG. 7B is a right end view of the assembly shown in FIG. 7A.
Figure 7D:
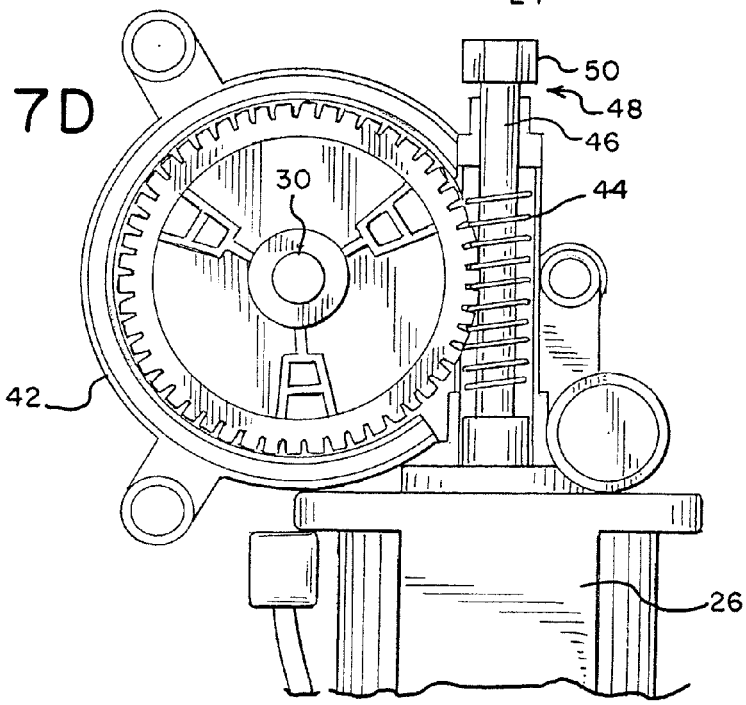
FIG. 7D is a view of the override for the drive motor, with the housing for the override removed in order to illustrate detail.

As explained above, the drive gear 28 is mounted on a spindle 30 (shown in FIG. 7D) driven by the motor 26. Also mounted on the spindle 30 is a worm wheel 40 located within an override housing 42 extending from the motor 26. The worm wheel 40, in turn, engages a worm gear 44 formed on a shaft 46 of a manual override 48. The shaft 46 is capped with a connector in the form of a hex head 50 which may be engaged by an appropriately-sized socket tool (not illustrated).

When the protective housing 18 is in place, the motor 26 and the drive gearing is fully encapsulated within the protective housing. To permit access to the manual override 48, the housing 18 includes an aperture covered with a removable cap 52. The cap 52 may be a flexible rubber plug or any other means of readily covering the aperture formed in the housing 18. With removal of the cap 52, the hex head 50 of the manual override 48, which is in registration with the aperture, can be engaged by a socket wrench or similar tool.

The motor 26 is used to rotate the roller 14 to extend or retract the awning 12. Normally, the manual override 48 spins harmlessly and out of sight within the housing 18 when the motor 28 is operated. Should the motor 28 fail or should electrical power to the motor 28 not be available, the roller 14 can still be rotated manually. To this end, the cap 52 is removed, and a socket wrench or the like engaged on the hex head 50 of the manual override 48. By driving the hex head 50 in one direction or the other, the roller 14 is thus manually rotated via the drive gear 28 and drive wheels 32, 36 and 38. Failure of the motor 28 for whatever reason when the awning 12 is deployed therefore will not strand a user of the awning should the awning be on a recreational vehicle that is to be moved.

The support system 20 is shown in greater detail in FIGS. 8-11. Two of the support systems 20 are utilized, as best shown in FIGS. 1-4, each of the support systems 20 being connected to an opposite end of the roller 14. The support systems are preferably mirror images of one another for aesthetic purposes, although they may be identical.

Each of the support systems 20 includes a support arm 60. As the awning 12 is deployed or retracted, the support arm is operable to move from a retracted position proximate a wall 62 of the recreational vehicle 10, where the support arm 60 is substantially vertical, to an extended position where the support arm 60 is substantially horizontal and displaced from the retracted position. To that end, a stile 64 is fixed to the wall 62. A top mounting arm 66 is pivotally connected to an upper location on the stile 64, while a bottom mounting arm 68 is pivotally connected at a lower position on the stile 64. Preferably each is connected by an identical bearing, with the bearing 70 shown in FIG. 9 where the bottom arm 68 connects to the stile 64, the bearing for the top arm 66 being identical.

The arms 66 and 68 are pivotally connected to and extend from the support arm 60 by means of bearings 72 and 74. The bearings 72 and 74 may be identical to the bearing 70. An extensible strut 76 is connected to and extends between the top and bottom mounting arms 66 and 68, as shown. The strut 76 is pivotally connected to the arms 66 and 68, such as by means of bearings 78 and 80. The bearings 78 and 80 may also be identical to the bearing 70. Preferably, the strut comprises a normally-extended pneumatic cylinder which, when the awning 12 is extended, biases the awning to the open and extended position.

As shown in FIG. 9, the bearing 80 is spaced from the bearing 70 along the bottom mounting arm 68. Performance of the awning 12 is improved by including the separate bearing 80, rather than mounting the bottom of the strut 76 concentrically with the bearing 70.

The bottom mounting arm 68 preferably is articulated, comprising first and second arm elements 82 and 84. The arm elements 82 and 84 are adjustable relative to one another and are joined by an adjustment coupler in the form of a bolt 86 capped by a nut 88.

Normally the arm elements 82 and 84 are axially aligned, as shown in the drawing figures. When the awning 12 is deployed to the fully extended position, typically the flexible canopy 16 is substantially horizontal. That orientation can be changed, however, by loosening the nut 68 on one side of the awning 12 and repositioning the arm elements 82 and 84 at an angle relative to one another. That, consequently, pitches the flexible canopy 16 by withdrawing the support arm 60 slightly. When the awning 12 is retracted, however, manual readjustment of the arm elements 82 and 84 is unnecessary. Due to the geometry of the support system 20, the arm elements 82 and 84 are self-regulating to be axially realigned when the awning 12 is retracted.

Various changes can be made to the invention without departing from the spirit thereof or scope of the following claims.

What is claimed is:

1. In a retractable awning for mounting to a wall, the awning including a roller, a flexible canopy having one end secured to the roller and rollable onto the roller, and a motor operable to rotate the roller to roll the flexible canopy onto or off the roller, the improvement comprising a. a pair of support arms supporting opposite ends of the roller, each support arm being operable to move from a retracted position proximate the wall where said arm is substantially vertical to an extended position where said arm is substantially horizontal and displaced from said retracted position, b. a pair of top and bottom mounting arms pivotally connected to and extending from each support arm, each top mounting arm being connected to an upper location on the wall and each bottom mounting arm being connected to a lower location on the wall, at least one of the bottom mounting arms including first and second arm elements, each first arm element pivotally articulated with its corresponding second arm element, and c. an extensible strut pivotally connected to and extending between each top arm and bottom mounting arm at connection locations spaced from and displaceable from the wall.

2. The retractable awning according to claim 1, in which said strut comprises a normally-extended pneumatic cylinder.

3. The retractable awning according to claim 1, in which said first and second arm elements are joined by an adjustment coupler.

4. The retractable awning according to claim 3, in which said adjustment coupler comprises a bolt.

5. The retractable awning according to claim 3, in which said adjustment coupler is operable to allow selective displacement of first and second arm elements from an axially-aligned orientation when said awning is extended and realignment said first and second arm elements to an axially-aligned orientation when said awning is returned to the retracted position.

6. The retractable awning according to claim 4, in which said adjustment coupler further comprises a nut engaged with said bolt.

7. A retractable awning comprising:

a roller;

a flexible canopy having one end secured to the roller and rollable onto the roller;

a motor operable to rotate the roller to roll the flexible canopy onto or off of the roller; and a support mechanism comprising:

a. a stile;

b. a pair of support arms supporting opposite ends of the roller, each support arm being operable to move from a retracted position where the support arm is substantially parallel to and proximate the stile to an extended position where the support arm is substantially perpendicular to and displaced from the stile;

c. a pair of top and bottom mounting arms pivotally connected to and extending from each support arm, each top mounting arm being connected to a top mounting arm location on the stile, a bottom mounting arm being connected to a bottom mounting arm location on the stile, at least one of the bottom mounting arms comprising first and second arm elements, each first arm element in pivotally articulated engagement with its corresponding second arm element; and d. an extensible strut pivotally connected to and extending between each top arm and bottom mounting arm at connection locations spaced from and displaceable from the stile.

8. The retractable awning according to claim 7, further comprising an adjustment coupler joining said first and second arm elements.

9. The retractable awning according to claim 8, in which said adjustment coupler comprises a bolt.

10. The retractable awning according to claim 9, in which said adjustment coupler further comprises a nut engaged with said bolt.

11. The retractable awning according to claim 7, in which said strut comprises a normally-extended pneumatic cylinder.

12. The retractable awning according to claim 7, in which said top and bottom mounting arms are pivotally connected to each support arm at corresponding connection points, at least one of said connection points comprising a bearing.

13. The retractable awning according to claim 7, in which said adjustment coupler is operable to allow selective displacement of first and second arm elements from an axially-aligned orientation when said awning is extended and realignment said first and second arm elements to an axially-aligned orientation when said awning is returned to the retracted position.

14. A retractable awning comprising:

a roller;

a flexible canopy having one end secured to the roller and rollable onto the roller;

a motor operable to rotate the roller to roll the flexible canopy onto or off of the roller; and a support mechanism configured for attachment to a wall, comprising:

a. a pair of support arms supporting opposite ends of the roller, each support arm being operable to move from a retracted position where the support arm is substantially parallel to and proximate the wall to an extended position where the support arm is substantially perpendicular to and displaced from the wall;

b. a pair of top and bottom mounting arms pivotally connected to and extending from each support arm, each top mounting arm being configured for connection to a top mounting arm location on the wall, a bottom mounting arm being configured for connection to a bottom mounting arm location on the wall, at least one of the bottom mounting arms comprising first and second arm elements, each first arm element in pivotally articulated engagement with its corresponding second arm element; and c. an extensible strut pivotally connected to and extending between each top arm and bottom mounting arm at connection locations spaced from and displaceable from the wall.

15. The retractable awning according to claim 14, further comprising an adjustment coupler joining said first and second arm elements.

16. The retractable awning according to claim 15, in which said adjustment coupler comprises a bolt.

17. The retractable awning according to claim 16, in which said adjustment coupler further comprises a nut engaged with said bolt.

18. The retractable awning according to claim 14, in which said strut comprises a normally-extended pneumatic cylinder.

19. The retractable awning according to claim 7, in which said adjustment coupler is operable to allow selective displacement of first and second arm elements from an axially-aligned orientation when said awning is extended and realignment said first and second arm elements to an axially-aligned orientation when said awning is returned to the retracted position.

* * * * *